US012434097B2

(12) United States Patent
Egli et al.

(10) Patent No.: US 12,434,097 B2
(45) Date of Patent: Oct. 7, 2025

(54) DEVICE FOR TRAINING THE PELVIC FLOOR MUSCLES

(71) Applicant: ALONEA AG, Seuzach (CH)

(72) Inventors: Wendelin Kilian Egli, Seuzach (CH); Fritz Fuchs, Uster (CH)

(73) Assignee: ALONEA AG, Seuzach (CH)

( * ) Notice: Subject to any disclaimer, the term of this patent is extended or adjusted under 35 U.S.C. 154(b) by 81 days.

(21) Appl. No.: 18/280,781

(22) PCT Filed: Mar. 24, 2022

(86) PCT No.: PCT/EP2022/057813
§ 371 (c)(1),
(2) Date: Sep. 7, 2023

(87) PCT Pub. No.: WO2022/214329
PCT Pub. Date: Oct. 13, 2022

(65) Prior Publication Data

US 2024/0149112 A1 May 9, 2024

(30) Foreign Application Priority Data

Apr. 7, 2021 (EP) ..... 21167185

(51) Int. Cl.
*A63B 23/20* (2006.01)
*A63B 21/00* (2006.01)
(Continued)

(52) U.S. Cl.
CPC ..... *A63B 23/20* (2013.01); *A63B 21/00189* (2013.01); *A63B 21/008* (2013.01);
(Continued)

(58) Field of Classification Search
CPC . A63B 23/20; A63B 21/00189; A63B 21/008; A63B 24/0062; A63B 2208/0233;
(Continued)

(56) References Cited

U.S. PATENT DOCUMENTS 5,674,238 A 10/1997 Sample et al.
6,436,029 B1 * 8/2002 Benderev ..... A61H 19/34 128/885
(Continued)

FOREIGN PATENT DOCUMENTS

DE 20218376 U1 2/2003

OTHER PUBLICATIONS

Jun. 28, 2022 International Search Report issued in International Patent Application No. PCT/EP2022/057813.
(Continued)

*Primary Examiner* — Sundhara M Ganesan
(74) *Attorney, Agent, or Firm* — Oliff PLC

(57) ABSTRACT

The training device (9), which is provided for training body parts of a user, in particular the hip muscles, gluteal muscles or pelvic muscles or the arm muscles, comprises a compressive-force receiver (1), which is deformable under the impact of muscular force and which comprises a pressure chamber (10) in which a gel-like, liquid or gaseous medium is provided, a base (2) which, on the one hand, is supportable on a supporting surface and, on the other hand, serves for holding the compressive-force receiver (1), and at least one sensor (51), such as a pressure sensor or a force sensor, with which the medium is in contact and with which the pressure of the medium in the pressure chamber (10) is measurable. According to the invention

Figure 1A:
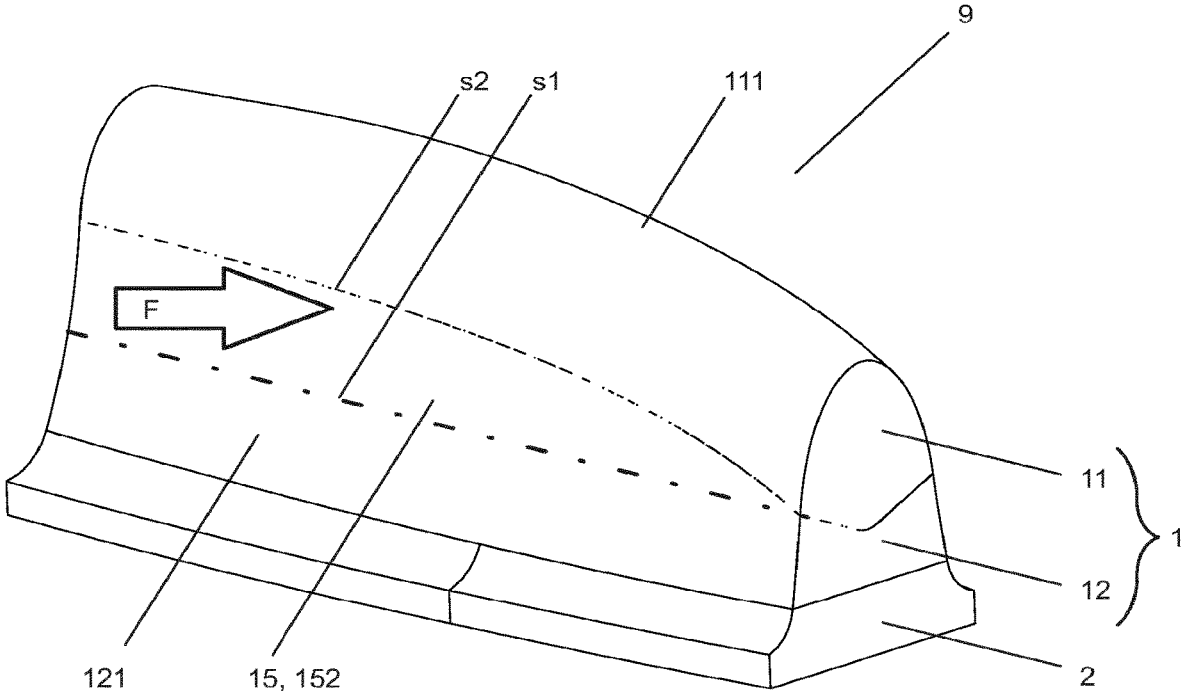

- the compressive-force receiver (1) comprises an elastically deformable first receiver part (11) and a second receiver part (12) which are connected form-fittingly, force-fittingly, or integrally to one another;
- the first receiver part (11) comprises a wall system (15) which serves to receive the muscular force and which delimits the pressure chamber (10) at the top and at least partially laterally;

(Continued)

the second receiver part (12) comprises a bottom unit (16) which delimits the underside of the pressure chamber (10) and which adjoins the wall system (15);

the second receiver part (12) has a lower elasticity than the first receiver part (11), preferably in parallel to the direction in which the muscular force acts; and the second receiver part (12) is connected releasably, form-fittingly or force-fittingly, or integrally to the base (2).

15 Claims, 8 Drawing Sheets

(51) Int. Cl.
*A63B 21/008* (2006.01)
*A63B 24/00* (2006.01)

(52) U.S. Cl.
CPC .. *A63B 24/0062* (2013.01); *A63B 2208/0233* (2013.01); *A63B 2220/56* (2013.01); *A63B 2220/58* (2013.01); *A63B 2220/833* (2013.01); *A63B 2225/093* (2013.01)

(58) Field of Classification Search
CPC ..... A63B 2220/56; A63B 2220/58; A63B 2220/833; A63B 2225/093; A63B 2071/065; A63B 2209/00; A63B 2220/51; A63B 2220/52; A63B 2225/50; A63B 2225/62; A63B 2230/50
See application file for complete search history.

(56) References Cited

U.S. PATENT DOCUMENTS

| | | | | |
|---|---|---|---|---|
| 2007/0142191 | A1 | 6/2007 | Schuurmans Stekhoven et al. | |
| 2007/0287610 | A1 | 12/2007 | Novak et al. | |
| 2010/0262049 | A1 | 10/2010 | Novak et al. | |
| 2011/0015472 | A1* | 1/2011 | Lee | A63B 23/0244 600/29 |
| 2015/0273270 | A1 | 10/2015 | Brinkhaus et al. | |
| 2016/0008664 | A1* | 1/2016 | Siegel | A63B 71/0622 482/8 |
| 2016/0278958 | A1 | 9/2016 | Yoshitake et al. | |
| 2017/0095207 | A1 | 4/2017 | Thomas et al. | |
| 2020/0384311 | A1 | 12/2020 | Zemp et al. | |
| 2022/0062700 | A1* | 3/2022 | Ng | A61B 5/227 |
| 2022/0386897 | A1* | 12/2022 | Rodionov | A61B 5/1107 |

OTHER PUBLICATIONS

Jun. 28, 2022 Written Opinion issued in International Patent Application No. PCT/EP2022/057813.

* cited by examiner

DEVICE FOR TRAINING THE PELVIC FLOOR MUSCLES

The invention relates to a device for training the pelvic floor muscles and possibly other parts of the body, such as the arm muscles and hand muscles.

The pelvic floor is the lower closure of the small pelvis. It consists of three muscle layers, which only have narrow openings for the intestines, urinary and genital organs. From the inside out, these are, diaphragma pelvis as the strongest largest layer, diaphragma urogenitale, a trapezoidal muscle plate covered on both sides by strong connective tissue, and the external sphincter layer, which comprises various muscles as the external pelvic floor muscles. The three muscle layers are arranged one above the other in a fan shape and are connected to each other at several points via muscle fibres and fascia.

The described muscle system is thus of vital importance for the body's condition and numerous bodily functions as well as posture and well-being and should always be kept in good condition through physical exercise.

US2010262049A1 discloses a pelvic floor training device for stimulating the pelvic floor muscles, comprising a tubular compressive-force receiver deformable within the crotch of a human body by actuating the muscle system of the pelvic floor muscles. The tubular pressure receiver consists of an elastic cylinder filled with a fluid and sealed on both sides.

Forces exerted on the tubular compressive-force receiver are detectable by a sensor so that the current training and the training progress can be monitored. A pressure sensor is installed on one end face of the tubular compressive-force receiver, by means of which the muscle contraction can be recorded.

A disadvantage of this device is that the tubular compressive-force receiver, which is inserted into a seat, hardly allows an optimal training of the relevant part of the user's body. The part of the body to be trained is only in contact with the tubular compressive-force receiver in a relatively small area, which is why on the one hand only a small part of the musculature is in contact with the compressive-force receiver and is trained and on the other hand undesirable pressure points can occur.

Another disadvantage is that the training device is not easy to clean and may not meet the hygienic requirements of the user. Liquid and dirt can possibly spread along the tubular compressive-force receiver and penetrate subsequent cracks or crevices and can only be removed again with considerable effort and after dismantling the tubular compressive-force receiver.

US2015273270A1 discloses a pelvic floor training device having a seat connectable to a compressive-force receiver, which comprises a longitudinally extending hollow body having an interior. A medium is provided in the interior of the hollow body, which is suitable for transmitting a pressure exerted by a user to the compressive-force receiver. The hollow body comprises a first fixed end portion and a second fixed end portion, which are held spaced apart from each other by a spacer element and are connected to each other by a flexible outer sheath which defines a closed interior space. The medium, the spacer element and a pressure or force measuring device, by means of which a pressure exerted by the outer casing on the medium can be measured, are arranged in the interior space. This training device is complex to manufacture and hardly adaptable to the needs of the user. The two end pieces must be manufactured separately with the corresponding effort and subsequently connected to the outer shell in a correspondingly complex work process. The spacer element must then be inserted into the interior space and the interior space filled with the medium and sealed tightly.

US2007142191A1 discloses a pelvic floor training device with a modular compressive-force receiver which can be inserted into a shell-shaped body and is held therein in such a way that the compressive-force receiver with a conical end piece can only expand in one direction. The conical end piece acts on a pressure sensor via a pressure distributor and a pressure conductor, which emits an electrical signal that depends on the pressure that results when force is applied to the compressive-force receiver.

This pelvic floor training device therefore comprises several parts that interact with each other and must therefore always be kept in correct contact with each other. Several parts must therefore be manufactured separately at a corresponding cost and connected to each other. The compressive-force receiver is to be inserted into the shell-shaped body, after which the shell-shaped body is to be inserted into a base plate. Subsequently, a housing is to be connected to the base plate, in which the pressure sensor is arranged. The pressure sensor is to be arranged in such a way that it is correctly brought into contact with the conical end piece of the compressive-force receiver via the pressure distributor and the pressure conductor.

The force transmission from the user's body to the pressure sensor is thus gradual and indirect via several interacting parts. Pressure is transmitted to the shell-shaped body and from there to the compressive-force receiver, which, through deformation and deflection of the conical end piece, transmits the pressure via the pressure distributor and the pressure conductor to the pressure sensor. The multiple transitions of the pressure from one part of the device to the other result not only in a complex system, but also in an imprecise measurement. The force that must be applied to deform the shell-shaped body is not recorded by the pressure sensor. The deflection of the conical end piece of the compressive-force receiver is therefore already not proportional to the force exerted by the user on the shell-shaped body. It should be noted that the flexible compressive-force receiver may also expand in other directions.

The described device parts that serve for transmitting force are typically also subject to wear, which is why the training device is prone to repair.

Furthermore, the device requires a considerable amount of cleaning, especially if dirt is to be removed from between the parts of the device. In this case, the training device must be disassembled, after which the individual parts must be cleaned. Dirt particles can accumulate inside the shell-shaped body, which are not easy to remove.

The present invention is therefore based on the object of creating an improved training device for pelvic floor training.

The training device should be simple in design so that it can be manufactured at low cost and is wear-resistant and thus maintenance-free.

It shall be possible to clean the training device completely with minimal effort and within a very short time, so that a hygienic training operation is always guaranteed. Especially in training centres, it shall be possible to use the training device within short intervals by several persons, who can clean the training device within a few seconds when leaving it.

The training device should work precisely so that training results can be recorded exactly and unaltered.

The training device shall allow an improved interaction between the body part to be trained and the pressure force receiver, so that all elements of the muscle system can be trained effectively. Therefore, the training device shall allow to achieve better training results.

The training device shall preferably be individually adaptable to the needs of each user. The training device shall be adaptable with simple measures to users whose physical dimensions differ significantly.

Painful pressure points shall not occur even after prolonged training with the training device. The training device shall therefore provide a pleasant training feeling, so that it is used intensively.

Furthermore, the training device shall be suitable for the training of further body parts, especially for the training of the arm muscles and the hand muscles.

The training device should also be suitable for training other parts of the body, especially the arm and hand muscles.

The solution of this task is achieved with a training device according to claim 1. Advantageous embodiments of the invention are defined in further claims.

The training device, which is provided for training body parts of a female or male user in particular the hip muscles, gluteal muscles or pelvic muscles or the arm muscles, comprises

- at least one compressive-force receiver, which is deformable under the impact of muscular force, and which comprises a pressure chamber in which a gel-like, liquid, or gaseous medium is provided,
- a base which, on the one hand, is supportable on a supporting surface, and, on the other hand, serves for holding the compressive-force receiver, and
- at least one sensor, such as a pressure sensor or a force sensor, with which the medium is in contact and with which the pressure of the medium in the pressure chamber is measurable.

According to the invention

- the compressive-force receiver comprises an elastically deformable first receiver part and a second receiver part which are connected to one another form-fittingly, force-fittingly, or integrally;
- the first receiver part comprises a wall system which serves to receive the muscular force and which delimits the pressure chamber at the top and at least partially laterally;
- the second receiver part comprises a bottom unit which closes the underside of the pressure chamber and which adjoins the wall system;
- the second receiver part has a lower elasticity than the first receiver part, preferably in parallel to the direction in which the muscular force acts; and
- the second receiver part is connected releasably, form-fittingly, or force-fittingly, or integrally to the base.

The compressive-force receiver may be made in one piece or may consist of two or more device parts corresponding to or different from the first and second receiver parts. For example, a first device part may be provided only as a cover for the pressure chamber, which is realised within the second device part. The second device part may therefore form the second receiver part and at least part of the first receiver part. The definition of the first and the second receiver part therefore refers to the completed compressive-force receiver after the assembly of the device parts, which are preferably form-fittingly joined and bonded together, e.g., with a tongue and groove connection, and practically form at last in this state a unit.

The first receiver part essentially comprises the wall system, which has two side walls for receiving the muscular force, which extend upwards towards each other and are connected to each other in one piece at the upper end. The opposing side walls of the wall system, which are subjected to muscular force, can extend towards each other at the front and/or rear and are preferably connected to each other in one piece. Alternatively, the two side walls can be connected to a front wall on the front side and/or to a rear wall on the rear side, preferably in one piece. In this way, advantageous shapes, such as round shapes or elliptical shapes, which are preferably adapted to the anatomy of the user, can be realised.

The dimensions and elasticity of the wall system can be advantageously adapted to the user's anatomy or the part of the body to be trained, resulting in improved interaction between the musculature and the pressure force transducer and thus improved training results. With the inventive training device, an elastic and large-area coupling of the pressure force transducer to the body part of the user is possible, so that even mothers who experience pain in the area of the pelvic floor muscles after the birth of a child can perform pelvic floor training with the training device. Painful pressure points can therefore be avoided even after prolonged training.

The inventive training device has the advantage that the contraction or relaxation of individual muscles or muscle groups (also referred to as relaxation) can be detected more precisely and preferably also selectively, so that for these muscles biofeedback training is possible with the aid of the inventive training device, in which the contraction behaviour of the muscles is measured and these muscles are then strengthened by training and their responsiveness is improved.

The inventive training device is not only suitable for the pelvic floor muscles, but also for training the trunk muscles. The trunk muscles form a supporting corset and include the deep back muscles on the back of the trunk and the deep transverse abdominal muscles on the front. All the muscle groups mentioned can be beneficially influenced with the training device, whereby the effect on the pelvic floor muscles is most intensive.

The training device can also be used to strengthen the hand muscles and arm muscles by compressing the compressive force transducer with one hand at a time only or by acting with both hands.

In preferred embodiments, the wall system is individually adapted to the user or manufactured or customised for the user. For this purpose, for example, a buttock impression of the user can be taken and measured. Measured dimensions can then be applied identically or at least approximately in the manufacture of the wall system. Furthermore, it can be provided that the elasticity of the side walls is not uniform but adapted to the needs of the user. In this case, curves can be defined considering a single user or a user group.

Alternatively, or additionally, the first receiver part can be provided with structuring elements, preferably made of metal or plastic, which are provided in receptacle openings, pockets, loops, recesses or receiving grooves on the receiver part that are open to the outside or closed to the outside. Reinforcing parts can thus be integrated into the training device, in particular into the compressive-force receiver or the base or can be attached or fastened to its outside.

The adaptation of the dimensions of the first receiver part or the wall system and, if necessary, a local or punctual stiffening can therefore optionally be carried out by the user as desired. Furthermore, auxiliary chambers can be provided which are filled with a medium.

In preferred embodiments, the wall system comprises at least one intermediate wall by which the pressure chamber is divided into sub chambers which are separated from each other along the longitudinal axis or a transverse axis. The sub chambers may be connected to each other through an opening in the intermediate wall, so that they can be filled together with a medium through a transfer opening. Alternatively, the two or more sub chambers can be completely separated from each other and can each be filled with the medium separately through a separate transfer opening. Provided that the sub chambers are separated from each other by the intermediate wall perpendicular to the longitudinal axis, the user can act on either the first or the second sub chamber, which preferably differ in elasticity, by shifting the sitting position along the longitudinal axis. For warming up or after fatigue, for example, the sitting position is shifted to act on the more elastic chamber part.

In preferred embodiments, two or more compressive-force receivers, which have the same compressibility or different compressibilities, can also be arranged preferably coaxially one behind the other and preferably connected to each other by a common base. The user can then select the appropriate compressive-force receiver for the training.

The compressive-force receiver and the associated or connectable base can be manufactured with an advantageous design that has a continuous surface without cracks and crevices. Advantageous designs can therefore be provided which are exceptionally beneficial in terms of aesthetics, training, and maintenance.

The appropriately designed training device can therefore be thoroughly cleaned with minimal effort so that it is immediately available for further use after use. Cracks and crevices or unevenness can be advantageously avoided so that dirt and liquid cannot accumulate.

The second receiver part serves on the one hand for the stable holding of the wall system and on the other hand for the stable connection with the base. The second receiver part and/or the base can also be used to adjust the height of the compressive-force receiver. Furthermore, the second receiver part and/or the base can be additionally reinforced.

For example, the second receiver part and/or the base are provided with outwardly closed or outwardly opened openings or recesses, such as receiving grooves, into which reinforcing elements or spacer elements can be inserted to stabilise the second receiver part and/or the base or to change its vertical extension. The second receiver part and/or the base are therefore preferably elastically expandable in the vertical direction, so that height adjustment is possible over a relatively wide range and the training device can be advantageously adapted to users with different body dimensions.

The pressure chamber of the compressive-force receiver can selectively be filled with a suitable medium. For this purpose, the wall system, or the bottom unit of the second receiver part has a transfer opening, preferably provided with an access valve, through which the medium can be introduced into the pressure chamber.

In preferred embodiments, it is provided a) that the sensor, or b) that the sensor with the associated electronic circuit and a communication module for wireless or wired communication, or c) that the sensor with the associated electronic circuit and a communication module for wireless or wired communication and with an accumulator, or d) that the sensor with the associated electronic circuit and a communication module for wireless or wired communication, with a rechargeable battery and with a charging coil is arranged inside or outside the pressure chamber. The electronic circuit can be arranged on a fixed or flexible printed circuit board.

If the sensor, and possibly associated device parts, is arranged inside the pressure chamber, the sensor is in direct or indirect contact with the medium inside the pressure chamber. If the sensor, and possibly associated device parts, is arranged outside the pressure chamber, the sensor is in direct or indirect contact with the medium outside the pressure chamber, which is led out of the pressure chamber through a connecting channel, a connecting line, if applicable a duct and/or a hose, which can have any cross-section. Associated device parts are, for example, an associated electronic circuit, for example an amplifier circuit, and/or a communication module for wireless or wired communication and/or power supply modules, such as charging coils, batteries, accumulators, power supplies or the like.

The wall system or the bottom unit of the second receiver part preferably has at least one connection opening through which connecting wires are led to the sensor inside or at the edge of the pressure chamber or from which the connecting channel or the connecting tube or the connecting hose is led to the sensor outside the pressure chamber. The at least one transfer opening through which a medium was previously introduced into the pressure chamber can also be used as a connection opening. Alternatively, a valve can be inserted into the transfer opening in which a pressure sensor is integrated.

If the sensor with the electronic circuit and the accumulator is arranged inside the pressure chamber, the accumulator is preferably charged via the charging coil, which can be inductively coupled to a charger.

In preferred embodiments, at least one temperature sensor is further provided, by means of which the temperature of the medium and/or the temperature of the wall system is measured. Taking the temperature measurement into account, the measurement results of the muscular force measurement can subsequently be corrected.

In particularly preferred embodiments, the base is designed as a seat or is connected to a seat element in one piece or is detachably connected in a form-fitting manner. The seat or the seat element is preferably symmetrical and preferably has the shape of a saddle.

Preferably, the seat element has a receiver channel along its central axis, which extends straight or inclined and into which the base with the compressive-force receiver can be inserted. Preferably, the base is held in the receiver channel in a form-fitting, displaceable and lockable manner.

The materials used to manufacture the training device are selected so that the individual parts of the training device have the required strength or elasticity. The first receiver part and the second receiver part are made of the same material or different materials. Similarly, the second receiver part and the base are made of the same material or different materials. If different materials are used, the elasticity of the wall system and the strength of the second receiver part and the base can be adapted by the choice of material, by dimensioning and/or by inserting reinforcing elements. If the same materials are used, the elasticity of the wall system and the strength of the second receiver part and the base are determined by dimensioning and/or by the insertion of reinforcing elements.

The first receiver part or a corresponding device part is preferably made of a first elastomer, such as silicone or rubber. The second receiver part is preferably made of a second elastomer such as silicone, rubber, or plastic (such as polycarbonate). The base is preferably made of a third elastomer such as silicone, rubber, or polycarbonate.

The inventive training device can be used by women or men, with female users particularly benefiting from training.

Figure 1B:
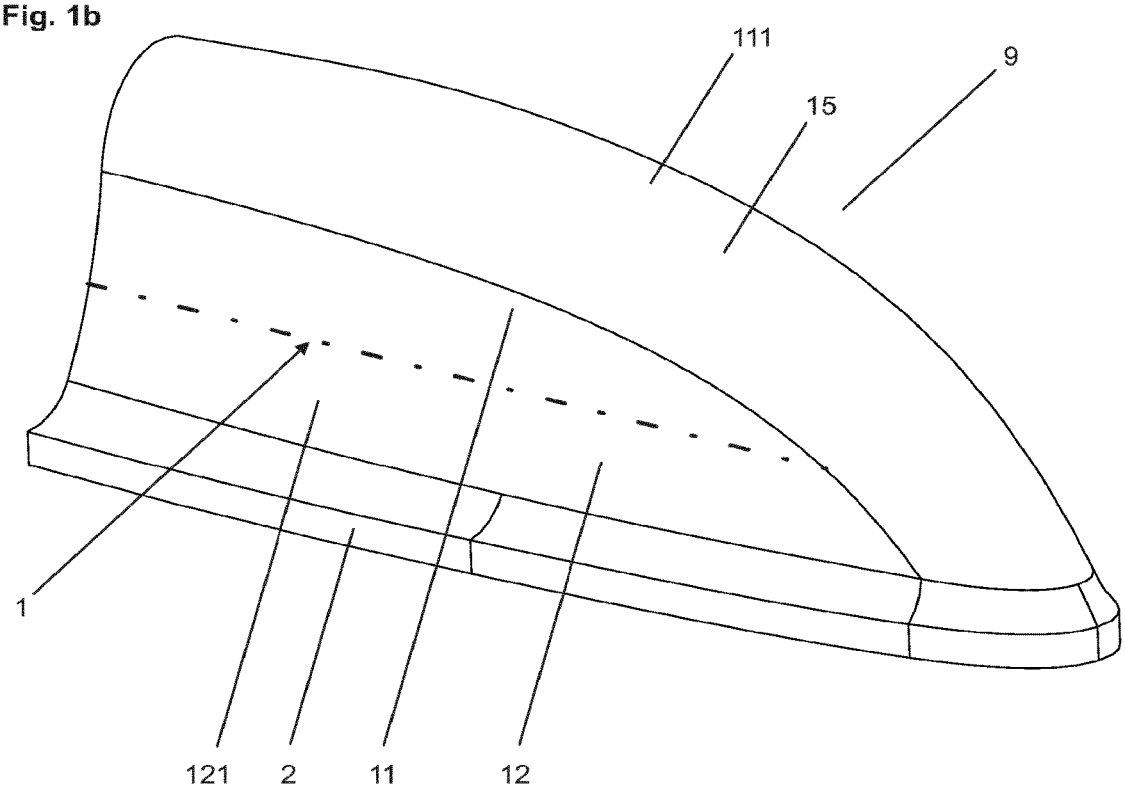
Figure 1C:
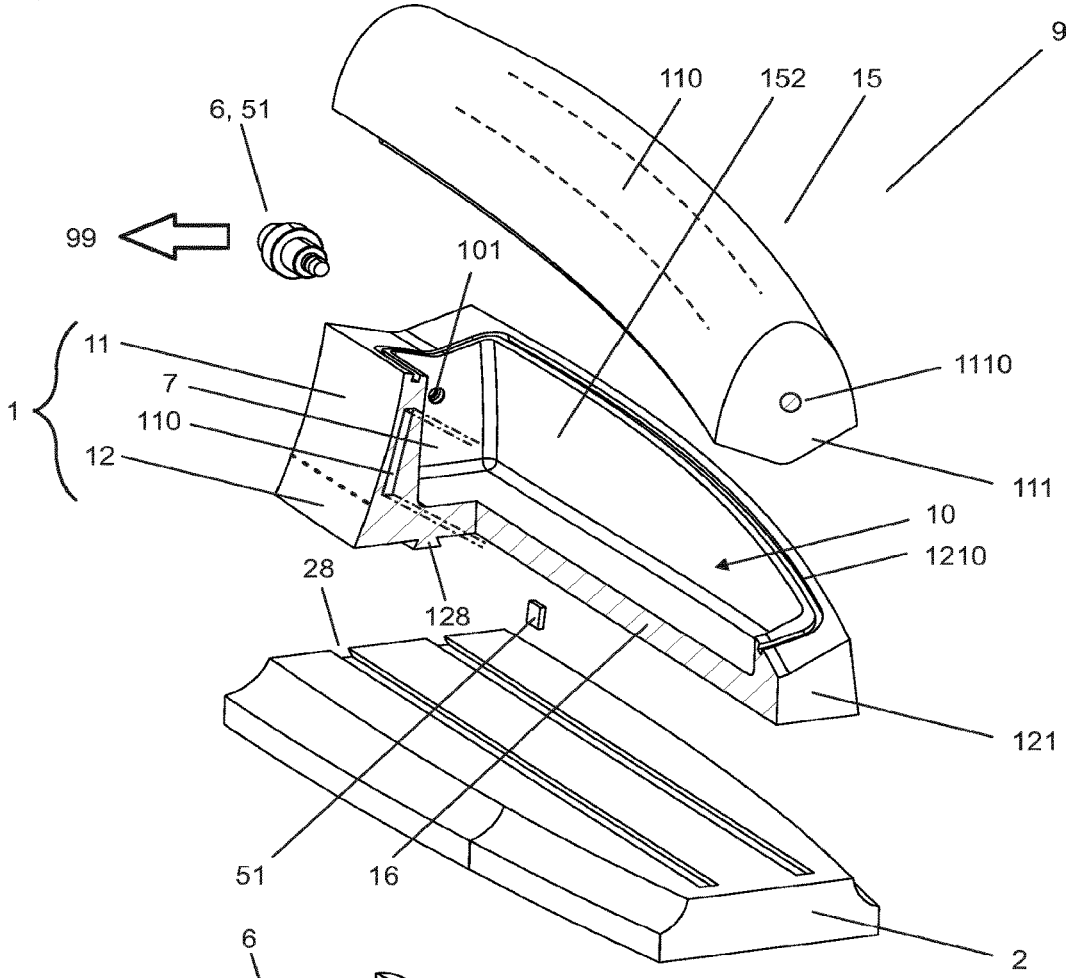
Figure 1D:
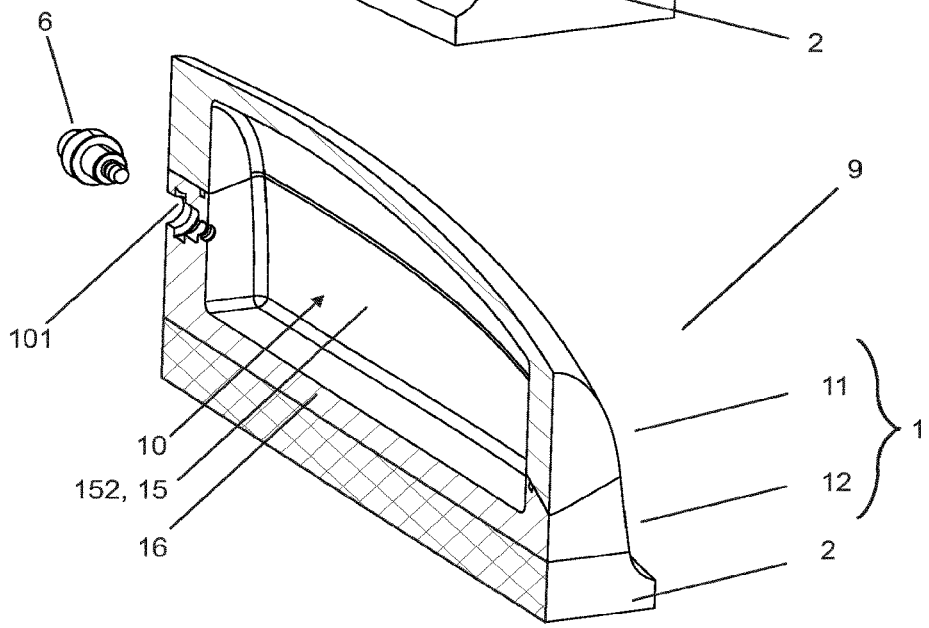
Figure 2:
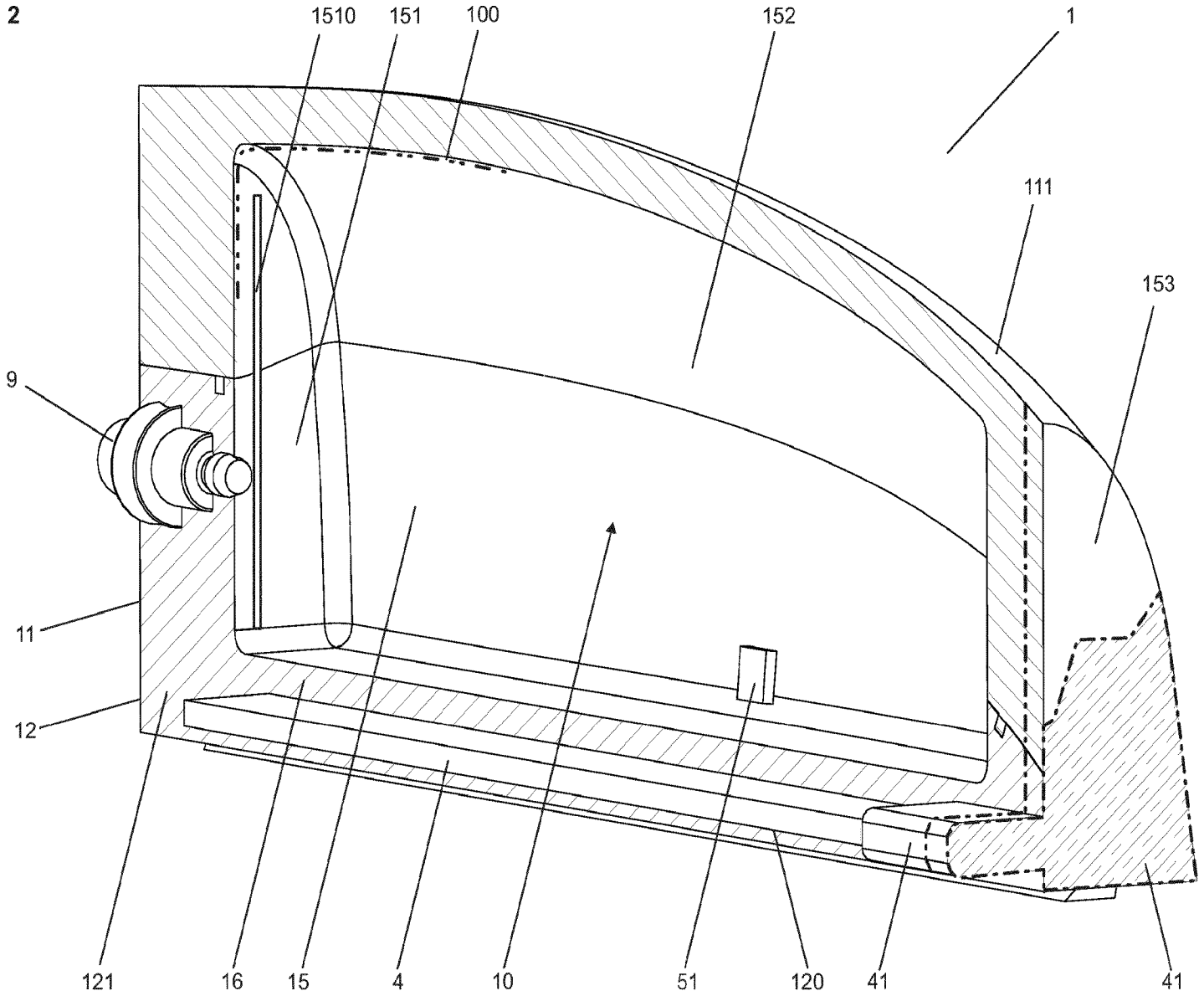
Figure 3B:
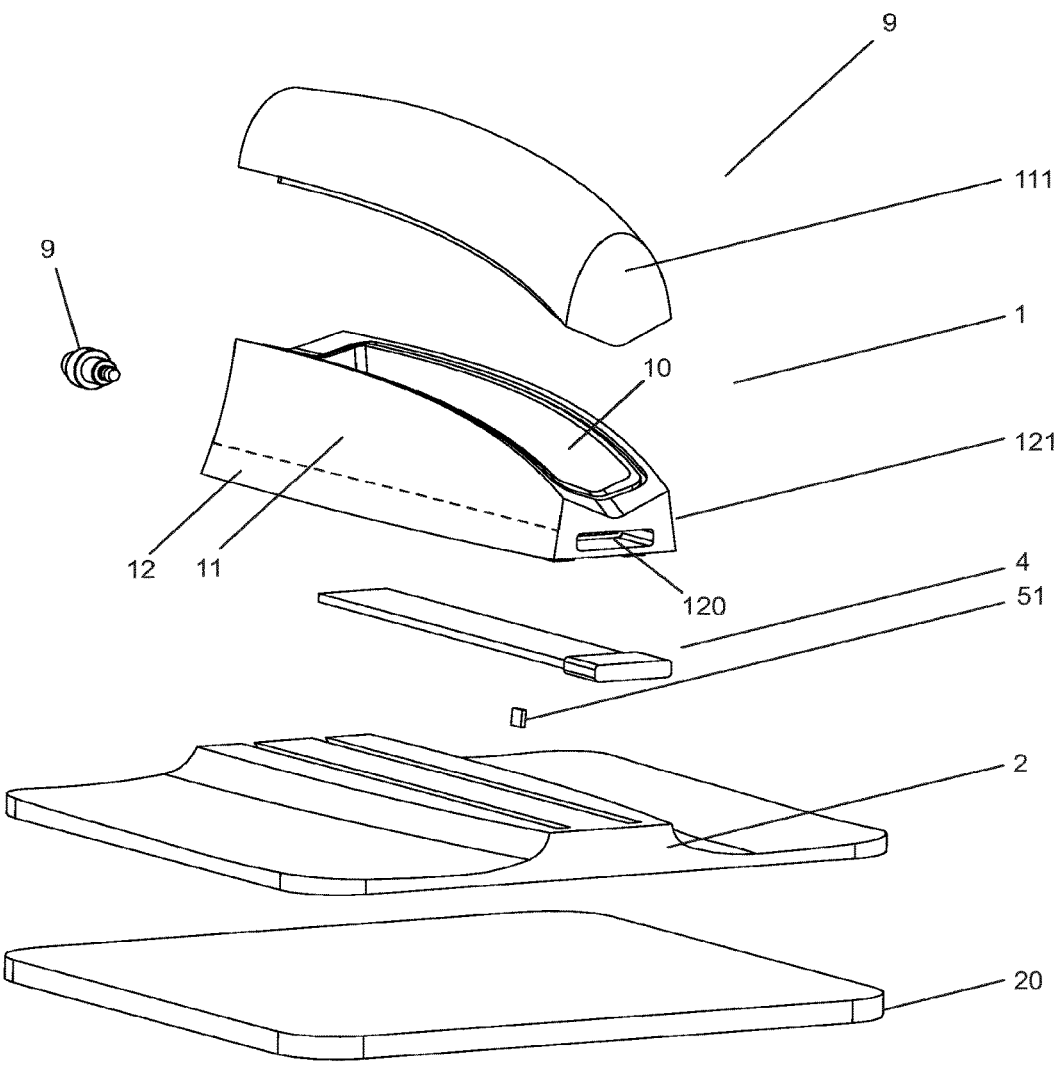
Figure 3A:
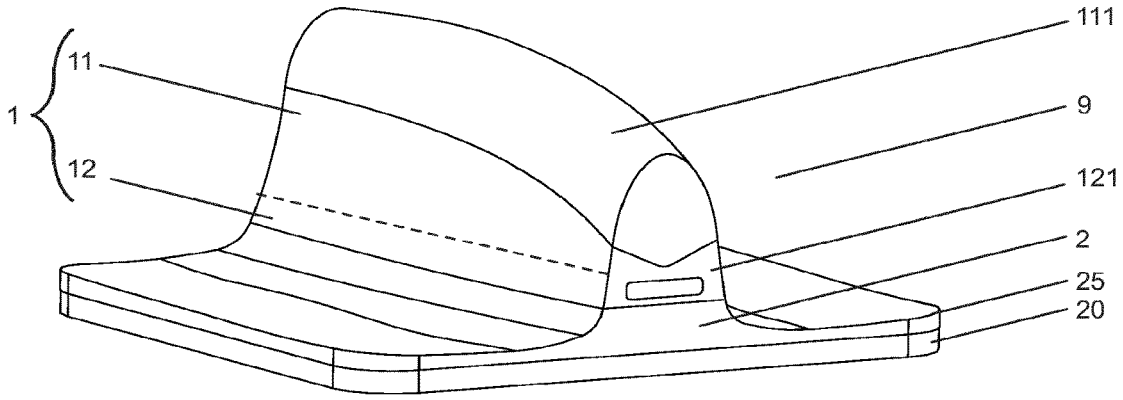
Figure 4:
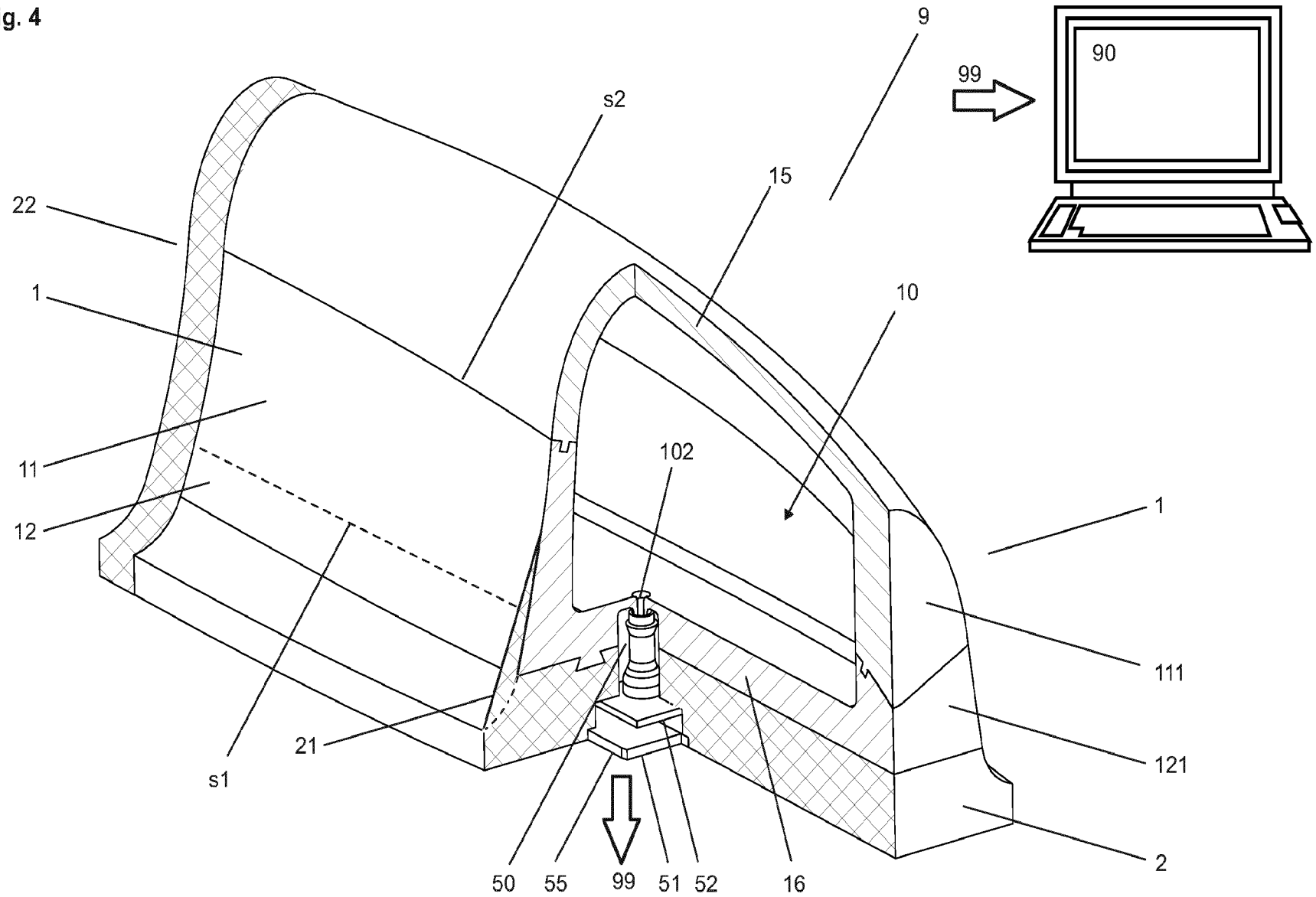
Figure 5B:
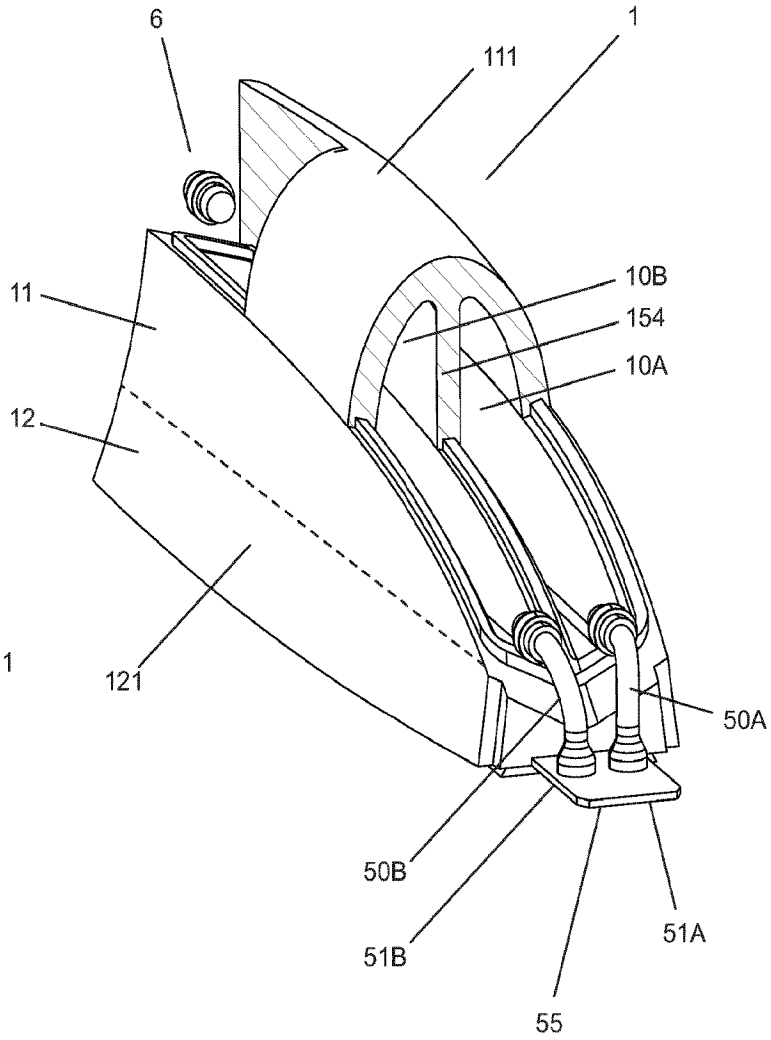
Figure 5A:
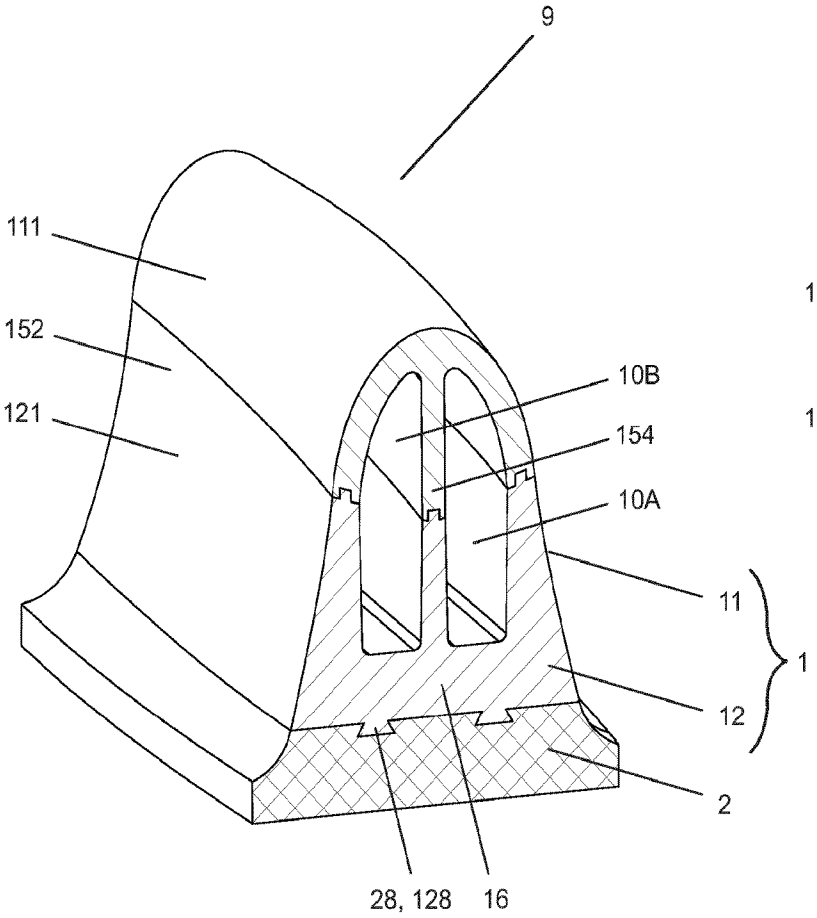
Figure 6A:
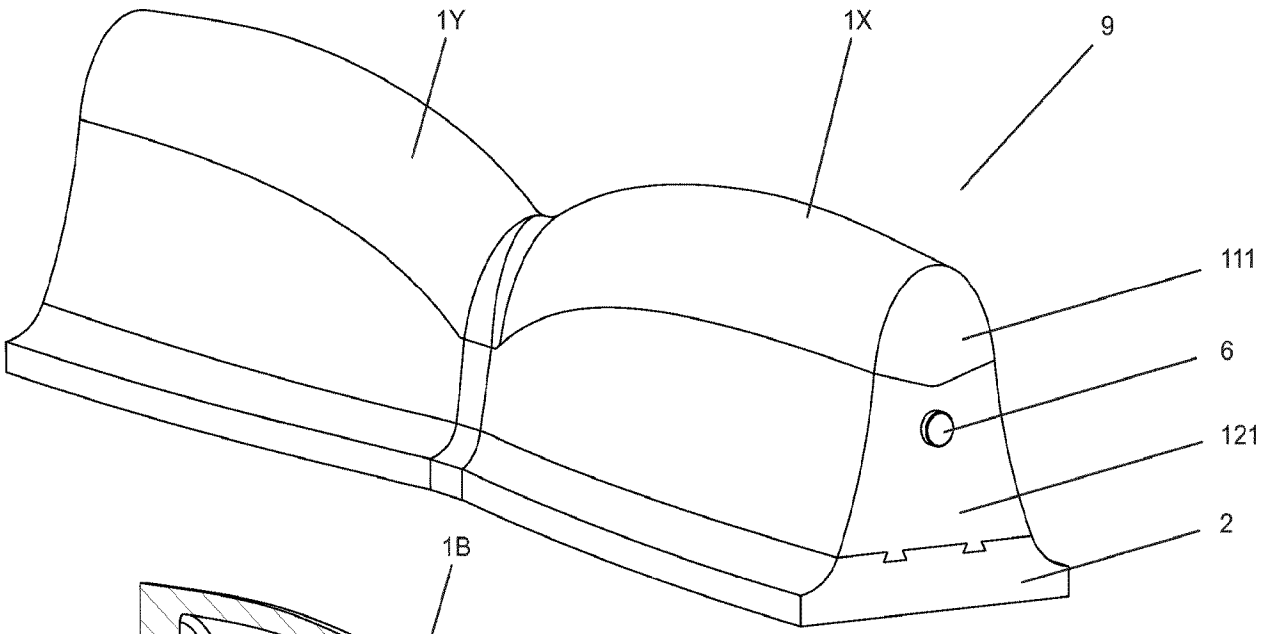
Figure 6B:
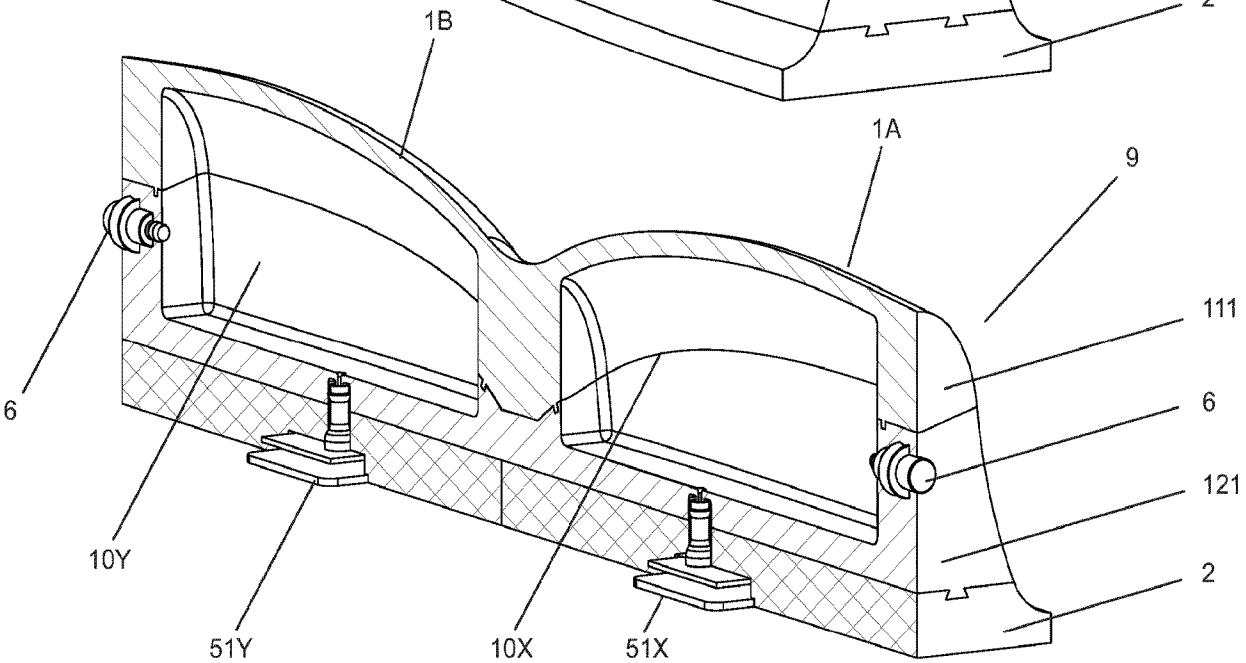
Figure 7A:
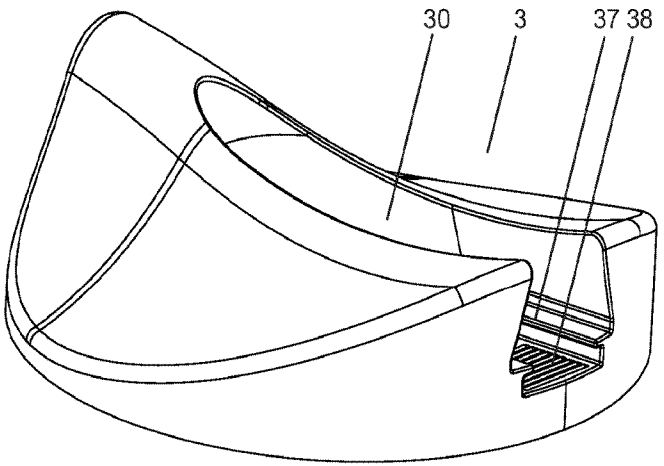
Figure 7B:
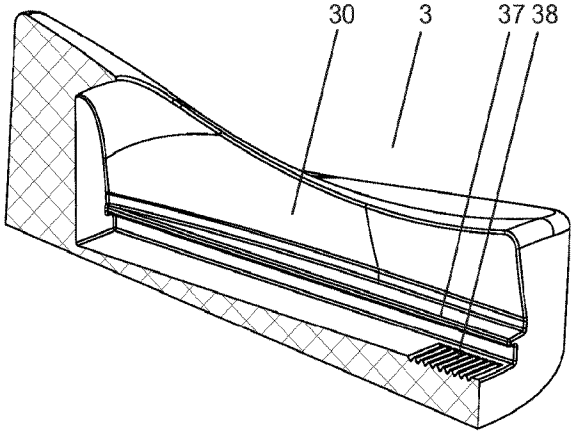
Figure 7C:
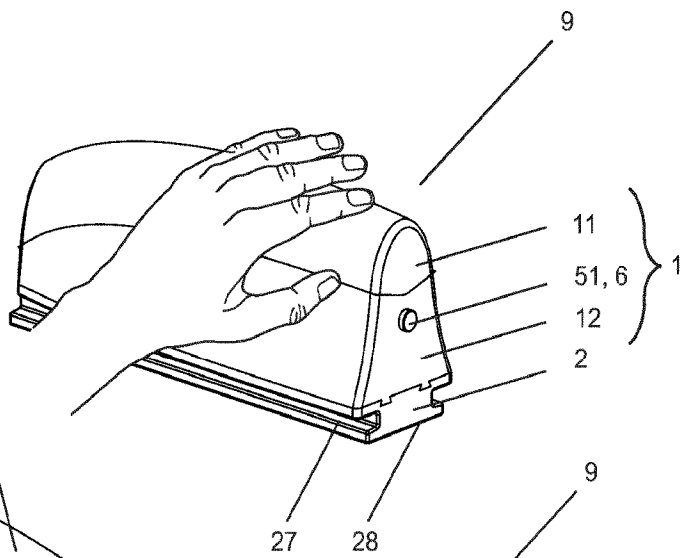
Figure 7C:
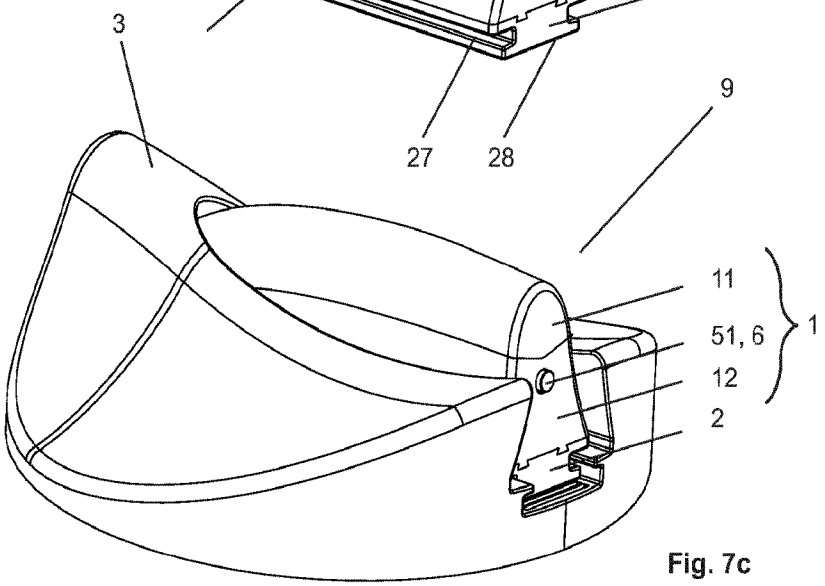

The invention is explained in more detail below with reference to the drawings. Thereby shows:

FIG. 1*a* a training device 9 with a compressive-force receiver 1, which is manufactured in one piece or is composed of a first device part 111 and a second device part 121 and which comprises a first receiver part 11 and a second receiver part 12, which enclose a pressure chamber, and with a base 2, the underside of which rests on a supporting surface and the upper side of which is connected to the second receiver part 12;

FIG. 1*b* the training device 9 of FIG. 1*a* in a further preferred embodiment;

FIG. 1*c* the training device 9 of FIG. 1*a* in exploded view with a section through the second device part 121, which comprises the second receiver part 12 and a part of the first receiver part 11;

FIG. 1*d* the training device 9 of FIG. 1*a* in a vertical section along its longitudinal axis;

FIG. 2 the training device 9 of FIG. 1*d* with a reinforcing element 4 inserted into a longitudinal opening 120 of the second receiver part 12;

FIG. 3*a* the training device of FIG. 1*a* in a further preferred embodiment with a base 2 that has been extended to form a seat;

FIG. 3*b* the training device 9 of FIG. 3*a* in an exploded view;

FIG. 4 the training device 9 of FIG. 1*a* with a quarter section with a view to a connection opening 102 in the second receiver part 12, which is connected by a connection tube 50 to sensors 51, 52;

FIG. 5*a* a cross-section through the training device 9 of FIG. 1*a*, which in this preferred embodiment has a pressure chamber, which is divided into two sub chambers 10A, 10B by an intermediate wall 154;

FIG. 5*b* the compressive-force receiver 1 of the training device 9 of FIG. 5*a* with a longitudinal section of the front side and a cross-section on the rear side of the first device part 111 with connection lines 50A, 50B, which are connected on the one hand to the associated sub chamber 10A, 10B and on the other hand to an associated sensor 51A, 51B;

FIG. 6*a* a training device 9 with two compressive-force receivers 1X, 1Y, e.g., according to FIG. 2, which are coaxially aligned with each other;

FIG. 6*b* the training device of FIG. 5*a* in a vertical longitudinal section;

FIG. 7*a* an inventive training device 9 according to FIG. 1*a* with a preferably designed base 2 which can form-fittingly be anchored in a seat element 3;

FIG. 7*b* the seat element 3 of FIG. 7*a* in a vertical longitudinal section; and FIG. 7*c* the inventive training device 9 inserted in the seat element 3 of FIG. 7*a*.

FIG. 1*a* shows a training device 9 according to the invention, which is suitable for training body parts of a user, in particular the hip muscles, gluteal muscles or pelvic muscles or arm muscles.

The training device 9 comprises a compressive-force receiver 1 that is deformable under the influence of muscular force and is manufactured in one piece or is composed of a first device part 111 and a second device part 121. The compressive-force receiver 1 comprises a first receiver part 11 and a second receiver part 12, the underside of which is connected to a base 2.

In FIG. 1*a*, a first dotted line s1 is drawn along the compressive-force receiver 1 separating the first receiver part 11 and the second receiver part 12 of the compressive-force receiver 1. The second dotted line s2 shows the connecting line between the first device part 111 and the second device part 121, which form the compressive-force receiver 1 if it is not made in one piece. The first dotted line s1 thus relates to the separation of parts of the compressive-force receiver 1 that have different functions and characteristics. The second dotted line s2, on the other hand, concerns the assembly or manufacture of the compressive-force receiver 1, which is optionally in one piece or composed of several device parts. In a preferred embodiment, the dash-dotted lines s1, s2 can also be congruent. In this case, the receiver parts 11, 12 correspond exactly to the device parts 111, 121.

As shown for example in FIG. 4, the first receiver part 11 and the second receiver part 12, possibly the first device part 111 and the second device part 112, enclose a pressure chamber 10 into which a gel-like, liquid or gaseous medium is filled. It is shown that the first receiver part 11 and the second receiver part 12 are integrally connected to each other in the region of the first dotted line s1. The second line s2 shows the connecting line between the first and second device parts 111, 121, which are form-fittingly and by an adhesive force-fittingly connected to each other.

For measuring the media pressure, a measuring sensor 51 is provided, which is arranged on the underside of the pressure chamber 10 and is connected wirelessly or wired, optionally by a measuring line 99, to a computer system 90, such as a tablet computer or a cell phone. On the computer system 90, the measurement data is recorded and analysed so that feedback can be provided to the user. The measuring sensor 51 is arranged on an electronic circuit board 55, on which a temperature sensor 52 can also be provided, by means of which the temperature of the medium is measured.

The first receiver part 11 of the compressive-force receiver 1, which is elastically deformable under the impact of the user's muscles, comprises a wall system 15 for absorbing the muscular force, which delimits the pressure chamber 10 on the top and laterally.

The second receiver part 12, which is form-fittingly and/or force-fittingly connected to the base 2, comprises a bottom unit 16, which delimits the underside of the pressure chamber 10 and connects upwards to the wall system 15. The second receiver part 12 has a lower elasticity preferably in parallel to the direction in which the muscular force acts than the first receiver part 11.

FIG. 1*a* shows that the training device 9 is compact and has a surface without furrows and crevices. The compressive-force receiver 1 cannot be identified as such from the outside. The training device 9 can therefore be manufactured in an advantageous design and a shape optimally adapted to the user's anatomy. In addition, the training device 9 can be thoroughly cleaned within seconds, so that hygiene is guaranteed even in the case of intensive use by several users.

FIG. 1*a* shows that the force (arrow F) is applied in particular to the longer opposing side walls 152 of the wall system 15. The first device part 111 is preferably made of a particularly elastic material and/or has a thin wall so that the upper side of the first receiver part 11 or of the wall system 15 adapts optimally to the user's anatomy and an optimal contact with all muscle groups is always guaranteed.

FIG. 1*b* shows the training device 9 of FIG. 1*a* in a further preferred embodiment in which the compressive-force receiver 1 extends along a curve at the front up to the base 2. The compressive-force receiver 1 can therefore be shaped as desired to achieve a desired aesthetic or functional effect or a desired adaptation to the user's anatomy.

FIG. 1*c* shows the training device 9 of FIG. 1*a* in exploded view with a section through the second device part 121, which comprises the second receiver part 12 and a part of the first receiver part 11, which is covered by the first device part 111, which forms the remaining part of the first receiver part 11. The interconnected first and second device parts 111, 121 enclose a pressure chamber 10 which is accessible only through a transfer opening 101.

It is shown that the second device part 121 has a circumferential groove 1210 on the upper side, which serves to receive a circumferential tongue provided on the underside of the first device part 111. Hence, a form-fittingly connection results, which is preferably sealed and secured by an adhesive. Of course, other types of connection, preferably with advantageously moulded parts, can also be used.

A valve 6 is inserted into the transfer opening 101 through which the gaseous, liquid or gel-like medium is introduced into the pressure chamber 10. Preferably, a valve 6 is used in which a sensor or pressure sensor 51 is integrated, which is suitable for measuring the medium pressure. A pressure sensor 51 is further shown symbolically, which is provided inside the pressure chamber 10 in direct contact with the medium, connected by a medium line outside the pressure chamber 10 or integrated in the valve 6.

In preferred embodiments, the pressure sensor 51 with the associated electronics, preferably including at least one processor and a communication module, such as a Bluetooth module, is integrated into the pressure chamber 10. The medium provided in the pressure chamber 10, for example an oil or gas, is thereby well compatible with the corresponding module. If, however, an interaction with the medium is to be avoided, the electronic module may be encapsulated.

The second device part 121 comprises a stable bottom unit 16 of the pressure chamber 10 and thus forms the second receiver part 12, which is hardly deformed under the effect of muscular force during exercise. The second receiver part 12 or the bottom unit 16 of the second device part 121 is provided with shaped elements 128 on the underside, which can form-fittingly be connected to shaped elements 28 on the upper side of the base 2. The form elements 128, which are exemplarily formed as a dovetail, can be inserted into the complementary form elements 28 of the base 2.

The first receiver part 11 or the wall system 15 of the compressive-force receiver 1 is mounted on the bottom unit 16 of the second receiver part 12. The wall system 15 comprises the first device part 111 and parts of the second device part 121, in particular the side walls 152 of the wall system 15 provided for absorbing the muscular force, which are integrally formed on the bottom unit 16.

Due to the nature of the material and in particular the relatively small wall thickness of the side walls 152 compared to the thickness of the bottom unit 16, the wall system 15 is relatively easy to deform, at least when muscular force is applied perpendicular to the side walls 152, so that it is essentially held in shape by the counterpressure of the medium, which is preferably measured continuously.

FIG. 1*c* further shows that the side walls 152 are provided with one or more receptacle openings 110 into which structuring elements 41 can be inserted for reinforcing, shaping or dimensioning the wall system 15. The schematically shown structuring element 41 can be used to stabilise and/or widen the corresponding side wall 152.

The user can therefore adapt the training device 9 to her current needs with little effort. For example, at the beginning of a training period, a high flexibility of the side walls 152 may be desired. After strengthening the muscle system due to intensive training, the user may want a wall system 15 with reduced flexibility, which can be achieved by inserting the structuring elements 41.

If the wall system 15 is too narrow at the start of the training, structuring elements 41 can be used to increase the thickness or strength of the side walls 152. The structuring elements 41 can therefore advantageously be used to dimension the compressive-force receiver 1.

In preferred embodiments, lockable receptacle openings 110 are provided into which a medium, for example the medium of the pressure chamber 10, can be introduced. The receptacle openings 110 are provided as auxiliary chambers into which air can be injected, for example by means of an air pump. The user can therefore pump air into the auxiliary chambers 110 and then allow it to escape through a valve 6 until the wall system 15 reaches desired dimensions. Even with one auxiliary chamber 110 or two symmetrically arranged auxiliary chambers 110, the dimensions of the wall system 15 can be substantially changed. Particularly advantageously, an auxiliary chamber 110 can be provided in the first device part 111. A gaseous, liquid or gel-like medium can be introduced into the auxiliary chamber 110 through a transfer opening 1110, preferably provided with a valve 6, in order to change the dimensions of the first device part 111 and to adapt the upper area of the compressive-force receiver 1 to the anatomy of the user.

In preferred embodiments, the pressure in at least one of the auxiliary chambers 110 can also be measured. On the one hand, this allows the selected dimensioning of the wall system 15 to be checked. On the other hand, it is possible to individually measure different impacts on the wall system 15. In the auxiliary chamber 110, which is optionally provided in the first device part 111, particularly forces acting vertically from above on the wall system 15 can be measured. The measurement of these vertically acting forces makes it possible to determine whether the user has assumed the usual position. In addition, the measurement and evaluation of the forces acting laterally on the side walls 152 can be corrected considering the forces acting vertically. If a higher force is exerted on the pressure receiver from above, the pressure in the pressure chamber 10 can increase without any muscular force being exerted on the side walls 152.

The described options for varying the design of the compressive-force receiver 1 further confirms the essential advantages of the invention.

FIG. 1*d* shows the training device 9 of FIG. 1*a* in a vertical section along its longitudinal axis with the valve 6 removed from the transfer opening 101.

FIG. 2 shows the training device 9 of FIG. 1*d* with the wall system 15 having a front wall 151 and a rear wall 153 connected to the side walls 152. It is shown that the front wall is thicker than the side walls 152, which are slightly thinner than the rear wall 153. Together, the front wall 151, the rear wall 153 and the side walls 152 form the wall system 15 in the manner of a dome, which is closed at the lower side by the bottom unit 16 of the second receiver part 12 or the second device part 121.

In the bottom unit 16, a reinforcing element 4 is inserted into a longitudinal opening 120 of the second receiver part 12. By inserting the rod-shaped reinforcing element 4, the stability of the second receiver part 12 or the bottom unit 16 can be substantially increased. Further, by inserting one or more reinforcing elements 4 into the second receiver part 12 or the bottom unit 16, the compressive-force receiver 1 can be raised accordingly. On the rear side, the reinforcing element 4 is provided with a head piece 41, which stabilises the rear wall 153 and covers it optionally. The head piece is shown with dotted lines as a plate 41, which optionally connects to the rear wall 153.

After the reinforcing element 4 has been removed, the bottom unit 16 and the rear wall 153 are contracted by the amount of the reinforcing element 4.

FIG. 2 further shows that the wall system 15 may include a transfer slot 1510 through which a mould element 100 (shown dotted), optionally used to form the pressure chamber 10, may be removed after the compressive-force receiver 1 has been manufactured. For example, an inflated form element 100 is used, which can be cut open and removed through the transfer slot 1510.

FIG. 3*a* shows the training device 9 of FIG. 1*a* in a further preferred design with a base 2 that has been extended to form a seat. The second receiver part 12 provides a stable connection between the compressive-force receiver 1 and the base 2, which has wings 25 projecting far outwards on both sides to form an elastic seat base. A base plate 20 is provided underneath the base 2 to ensure a non-slip connection between the base 2 and the supporting surface. The base plate 20 is, for example, a rubber or plastic plate that is firmly or detachably connected to the base 2.

FIG. 3*b* shows an exploded view of the training device 9 of FIG. 3*a*.

FIG. 4, already referred to above, shows the training device 9 of FIG. 1*a* with a quarter section with a view to a connection opening 102 in the second receiver part 12, which is connected to sensors 51, 52 by a connection tube 50. Instead of a connecting tube 50, a connecting channel can also be provided, which is moulded into the compressive-force receiver 1, e.g., into the bottom unit 16.

The sensors 51, 52 can be arranged on a circuit board 55 on which further electronic components and possibly an accumulator or battery are provided. For example, a transmitter module is provided, by means of which measured values are transmitted wirelessly to the computer system 90. For example, a Bluetooth connection is automatically established between the training device 9 and the computer system 90.

As shown in FIG. 4, the base 2 can be flush with the underside of the compressive-force receiver 1 or partially overlap it. In an optional embodiment, the base 2 covers the bottom unit 16 and part of the wall system 15 with a lip 21. Alternatively, or additionally, the bottom unit 16 can also cover the front side and/or the rear side of the compressive-force receiver 1 with a wall element 22. By means of these optional elements, the compressive-force receiver 1 can form-fittingly be held and/or stabilised. The compressive-force receiver 1 can therefore only form-fittingly be connected to the base 2 in this way. The base 2 shown in sectional view and the optionally added parts 21, 22 are shown with the same hatching.

FIG. 5*a* shows a cross-section through the training device 9 of FIG. 1*a*, which in this preferred embodiment has a pressure chamber divided into two sub chambers 10A, 10B by an intermediate wall 154. The two sub chambers 10A, 10B can be connected to each other via an opening in the intermediate wall 154 or can be completely separated from each other. The intermediate wall 154 stabilises the compressive-force receiver 1 regarding forces acting vertically from above without reducing the elasticity of the compressive-force receiver 1 regarding forces acting laterally.

FIG. 5*b* shows the compressive-force receiver 1 of the training device 9 of FIG. 5*a* with a longitudinal section in the rear section and with a cross-section in the front section of the first device part 111. It is shown that connection lines 50A, 50B are connected on the one hand to the associated sub chamber 10A or 10B and on the other hand to an associated sensor 51A, 51B. By means of the sensor 51A, 51B, asymmetric impacts on the compressive-force receiver 1 can be measured and corresponding corrective measures can be initiated. The user can be advised to correct the sitting posture and to activate the muscles evenly.

FIG. 6*a* shows a training device 9 with two compressive-force receivers 1X, 1Y, e.g., according to FIG. 2, which are coaxially aligned with each other. The compressive-force receivers 1X, 1Y preferably have different properties, so that training can be carried out with the first or with the second compressive-force receiver 1X, 1Y as required. For example, the first compressive-force receiver 1X is more elastic than the second compressive-force receiver 1Y. The two compressive-force receivers 1X, 1Y can also have different dimensions or be adapted to work specific muscle groups.

FIG. 6*b* shows the training device of FIG. 5*a* in a vertical longitudinal section with the separate pressure chambers 10X, 10Y, which are provided each with a valve 6 and a sensor 51X, 51Y.

FIG. 7*a* shows an inventive training device 9 as shown in FIG. 1*a* with a preferably designed base 2 that can form-fittingly be anchored in a seat element 3. The seat element 3 has the shape of a saddle and is provided along its longitudinal axis with a receiver channel 30 into which the training device 9 is inserted and suitably positioned. The base 2 of the compressive-force receiver 1 is provided on both sides with grooves 27 in which oppositely directed wing elements 37, which are provided in the receiver channel 30, can engage. An optional grating 38 is provided at the underside of the receiver channel 30, which corresponds to a detent on the underside of the base 2. As soon as the user sits down on the compressive-force receiver 9, the latching elements 28, 38 engage with each other and lock the compressive-force receiver in the respective position. By reducing the applied weight, the compressive-force receiver 1 can be released from the latch 38, moved and fixed again. Preferably, the receiver channel 30 is inclined so that the height of the training device 9 is also changed by the displacement of the training device 9.

FIG. 7*b* shows the seat element 3 of FIG. 7*a* in a vertical longitudinal section with the grating 38 and a wing element 37.

FIG. 7*c* shows the inventive training device 9 inserted into the seat element 3 of FIG. 7*a*.

FIG. 7*a* further illustrates that the training device 9 is also suitable for training the hand muscles or the arm muscles. The compressive-force receiver 1 can be compressed with one hand or between both hands to strengthen the hand or arm muscles.

The invention claimed is:

1. A training device comprising a compressive-force receiver, which is deformable under an impact of a muscular force, and which comprises a pressure chamber in which a gel-like, liquid, or gaseous medium is provided, a base that is supportable on a supporting surface and that serves for holding the compressive-force receiver, and at least one sensor with which the medium is in direct contact and with which a pressure of the medium in the pressure chamber is measurable, wherein:

the compressive-force receiver comprises an elastically deformable first receiver part and a second receiver part, which the first receiver part and the second receiver part are connected form-fittingly, force-fittingly or integrally to one another and in which the first receiver part and the second receiver part define the pressure chamber;

the first receiver part comprises a wall system which serves to receive the muscular force and which delimits the pressure chamber at a top and at least partially laterally;

the second receiver part comprises a bottom unit which delimits an underside of the pressure chamber and which adjoins the wall system;

the second receiver part has a lower elasticity than the first receiver part; and the second receiver part is connected releasably, form-fittingly, or force-fittingly, or integrally to the base.

2. The training device according to claim 1, wherein the wall system comprises two side walls that are configured to receive the muscle force, the two side walls extending upwardly towards each other and are integrally connected to each other at an upper end.

3. The training device according to claim 2, wherein, the two side walls, at a front side and/or at a rear side, extend towards each other and are connected to each other; or the two side walls are connected at a front to a front wall and/or are connected at a rear to a rear wall.

4. The training device according to claim 2, wherein the two side walls have a uniform or a non-uniform thickness over an entire area and/or that the wall system is custom-made according to requirements of a user.

5. The training device according to claim 1, wherein the wall system or the bottom unit has at least one transfer opening through which the medium is introducible into the pressure chamber, wherein the transfer opening also serves as a connection opening for the sensor.

6. The training device according to claim 1, wherein, the sensor, or the sensor with an associated electronic circuit and a communication module for wireless or wired communication, or the sensor with the associated electronic circuit and the communication module for wireless or wired communication and with an accumulator, or the sensor with the associated electronic circuit and the communication module for wireless or wired communication, with a rechargeable battery and with a charging coil, is arranged outside or inside the pressure chamber.

7. The training device according to claim 1, wherein the sensor is arranged inside the pressure chamber and is in direct with the medium inside the pressure chamber; or the sensor is arranged outside the pressure chamber and is outside the pressure chamber in direct contact with the medium, which is conveyed through a connecting channel or through a connecting hose or a connecting tube to the sensor outside the pressure chamber, wherein the wall system or the bottom unit has at least one connection opening or a connecting channel through which connection wires are led to the sensor or to the associated electronic circuit inside the pressure chamber.

8. The training device according to claim 1, wherein the wall system comprises at least one intermediate wall by which the pressure chamber is divided into sub chambers which are interconnected by an opening through which the medium can pass and which are jointly fillable with the medium through a transfer opening; or the wall system has at least one intermediate wall by means of which the pressure chamber is divided into sub chambers which are separated from one another and are fillable with the medium separately each through a transfer opening.

9. The training device according to claim 1, wherein the first receiver part has at least one receptacle opening which is closed towards an outside, or a receptacle opening which is open towards the outside into which at least one structuring element is insertable, by means of which the wall system is modifiable with regard to dimensioning and/or strength.

10. The training device according to claim 1, wherein the second receiver part has at least one receptacle opening which is closed towards an outside or a receptacle opening, which is open towards the outside into which at least one reinforcing element is insertable, in order to reinforce the second receiver part or in order to adjust a height of the compressive-force receiver.

11. The training device according to claim 1, wherein at least two compressive-force receivers, which have the same compressibility or different compressibilities, are arranged coaxially one behind the other and are connected to one another.

12. The training device according to claim 1, wherein the base is designed as a seat or that the base is connected in one piece or form-fittingly detachable to a seat element.

13. The training device according to claim 12, wherein the seat element has a receiver channel along its a central axis, which extends straight or inclined, and into which the base with the compressive-force receiver is insertable, and in that the base is held form-fittingly, displaceably and lockably in the receiver channel.

14. The training device according to claim 1, wherein the first receiver part and the second receiver part are made of the same materials or of different materials and/or that the second receiver part and the base are made of the same material or of different materials.

15. The training device according to claim 1, wherein, the first receiver part is made of a first elastomer, and/or the second receiver part is made of a second elastomer, and/or the base is made of a third elastomer.

* * * * *